US007819399B2

(12) United States Patent
Choi

(10) Patent No.: US 7,819,399 B2
(45) Date of Patent: Oct. 26, 2010

(54) METHOD AND APPARATUS FOR RELIEVING STRESS IN A PRE-REGISTRATION NIP

(75) Inventor: Injae Choi, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 391 days.

(21) Appl. No.: 12/025,281

(22) Filed: Feb. 4, 2008

(65) Prior Publication Data

US 2009/0194936 A1 Aug. 6, 2009

(51) Int. Cl.
*B65H 7/02* (2006.01)

(52) U.S. Cl. ..... 271/228; 271/227; 271/242

(58) Field of Classification Search ..... 271/228, 271/227, 242

See application file for complete search history.

(56) References Cited

U.S. PATENT DOCUMENTS

| | | | | |
|---|---|---|---|---|
| 4,805,892 | A | 2/1989 | Calhoun | |
| 5,078,384 | A | 1/1992 | Moore | |
| 5,094,442 | A | 3/1992 | Kamprath et al. | |
| 5,156,391 | A | 10/1992 | Roller | |
| 5,235,862 | A | 8/1993 | Harada | |
| 5,253,862 | A * | 10/1993 | Acquaviva et al. | 271/251 |
| 5,676,477 | A * | 10/1997 | Tanaka et al. | 400/579 |
| 5,678,159 | A * | 10/1997 | Williams et al. | 399/395 |
| 5,681,036 | A * | 10/1997 | Wakahara et al. | 271/10.12 |
| 5,775,690 | A * | 7/1998 | Quesnel et al. | 271/242 |
| 5,794,176 | A * | 8/1998 | Milillo | 702/150 |
| 6,059,285 | A * | 5/2000 | Suga et al. | 271/228 |
| 6,135,446 | A * | 10/2000 | Thiemann et al. | 271/228 |
| 7,520,497 | B2 * | 4/2009 | Moriyama et al. | 270/58.07 |
| 2004/0251613 | A1 * | 12/2004 | Quesnel | 271/243 |
| 2007/0284810 | A1 * | 12/2007 | Nakazawa et al. | 271/228 |

* cited by examiner

*Primary Examiner*—Stefanos Karmis
*Assistant Examiner*—Howard Sanders

(57) ABSTRACT

A method of using a buckle for relieving the stresses in sheets caused by differential displacements of drive nips during the registration process includes creating a buckle between pre-registration nips and registration nips. The velocities of the pre-registration nips and registration nips are closely controlled so that the magnitude of buckle between them is large enough to relieve the stresses in the sheet during the registration process, yet small enough to not interfere with the registration process.

19 Claims, 4 Drawing Sheets

METHOD AND APPARATUS FOR RELIEVING STRESS IN A PRE-REGISTRATION NIP

This disclosure relates generally to sheet registration devices, and more particularly, to a method and apparatus for relieving stress on a sheet in registration nips of a registration system.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules to the latent image forming a toner powder image on the photoconductive member. The toner powder image is then transferred from the photoconductive member to a copy sheet. The toner particles are heated to permanently affix the powder image to the copy sheet.

In printing machines such as those described above, it is necessary to align and register the individual cut sheet so that the developed image is placed in the proper location on the sheet. Various schemes have been developed to assure that the image-receiving sheet is in the proper location and forwarded at the proper time. Some complex printing machines utilize various sensors and translating nips to align the sheet in the proper position for receiving the image. Other machines utilize variable speed stepping motors to differentially drive a sheet within a sheet path for deskew and registration purposes. Both of these registration methods require sophisticated control and are relatively high cost.

In U.S. Pat. No. 5,253,862 to Acquaviva et al., issued Oct. 19, 1993 a sheet handler is disclosed that includes an idler and driven cross roller set. The rollers are preloaded so that a normal force exists between the rollers at the nip. The nip is provided with an apparatus for adjusting the preloaded force to adjust the normal force on the sheet material passing through the nip.

A method and apparatus for deskewing and registering a sheet in a short paper path is shown in U.S. Pat. No. 5,156,391 issued Oct. 20, 1992 to Roller, by differentially driving two sets of rolls so as to create a paper buckle buffer zone in the sheet and then differentially driving a roll set to correct skew while the sheet is still within the nips of multiple drive roll sets.

U.S. Pat. No. 5,078,384 issued Jan. 7, 1992 to Moore discloses a method and apparatus for deskewing and registering a sheet, including the use of two or more selectably controllable drive rolls operating in conjunction with sheet skew and lead edge sensors for frictionally driving and deskewing sheets having variable lengths. Sheets will be advanced to reach a predetermined registration position at a predetermined velocity and time at which time the sheets will no longer be frictionally engaged by the drive rolls.

A loop is formed between upstream and downstream pairs of rollers in U.S. Pat. No. 4,805,892 by driving the downstream pair slower than the upstream pair and/or by a direction changing guide. The downstream pair of rollers is axially movable to bring an in-track edge of a sheet to a predetermined sensed position to cross-track register the sheet. The loop permits cross-track movement of the sheet despite engagement of the sheet with the upstream pair of rollers. The system of this patent suffers from not being able to control the magnitude of the buckle that is created between the upstream and downstream rollers, thus limiting the speed of the sheet handling system and the variety of sheet lengths that can be accommodated. In addition, only cross-track registration is accomplished with no registration in the process direction.

A registration system that can control the magnitude of the buckle created at the downstream registration rolls is shown in U.S. Pat. No. 5,094,442 where laterally spaced apart drive rolls are speed controlled to correct for skew mispositioning. Lateral registration is achieved by translation of the drive rolls transversely to the direction of sheet movement. Longitudinal registration is controlled by varying the speed of the drive equally. The system reduces the required paper path length to achieve correct registration, thereby allowing high speed operations. The buckle is controlled by releasing upstream nip rollers at the point where the registration system begins to make adjustments to the position of the sheet. This system, however, is costly. In addition, as the pages per minute become higher, the nip release mechanism will become more expensive and can also be limiting as the nip open/close timing requirement becomes more stringent. This patent and others mentioned heretofore are included herein by reference to the extent necessary to practice the present disclosure.

It is desirable to remove cost from the registration system of U.S. Pat. No. 5,094,442 while building in a capacity for increased speed and productivity.

Accordingly, an improved registration method and apparatus are disclosed that use a buckle for relieving the stresses in a sheet due to the differential displacements of drive nips during registration corrections. As the registration proceeds, a buckle is created between the registration nips and the pre-registration nips, and the differential displacement of the registration nips for correcting the registration errors are absorbed by this buckle instead of releasing the pre-registration nip as done in some applications heretofore. The velocities of the registration and pre-registration nips are closely controlled so that the magnitude of buckle between them is large enough to relieve the stresses in the sheet during the registration process, but not large enough to adversely impact registration.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

The disclosure will now be described by reference to a preferred embodiment xerographic printing apparatus that includes a method of loading multiple types of paper in a feed tray to allow printing of multiple jobs without operator intervention.

For a general understanding of the features of the disclosure, reference is made to the drawings. In the drawings, like reference numerals have been used throughout to identify identical elements.

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

Figure 1:
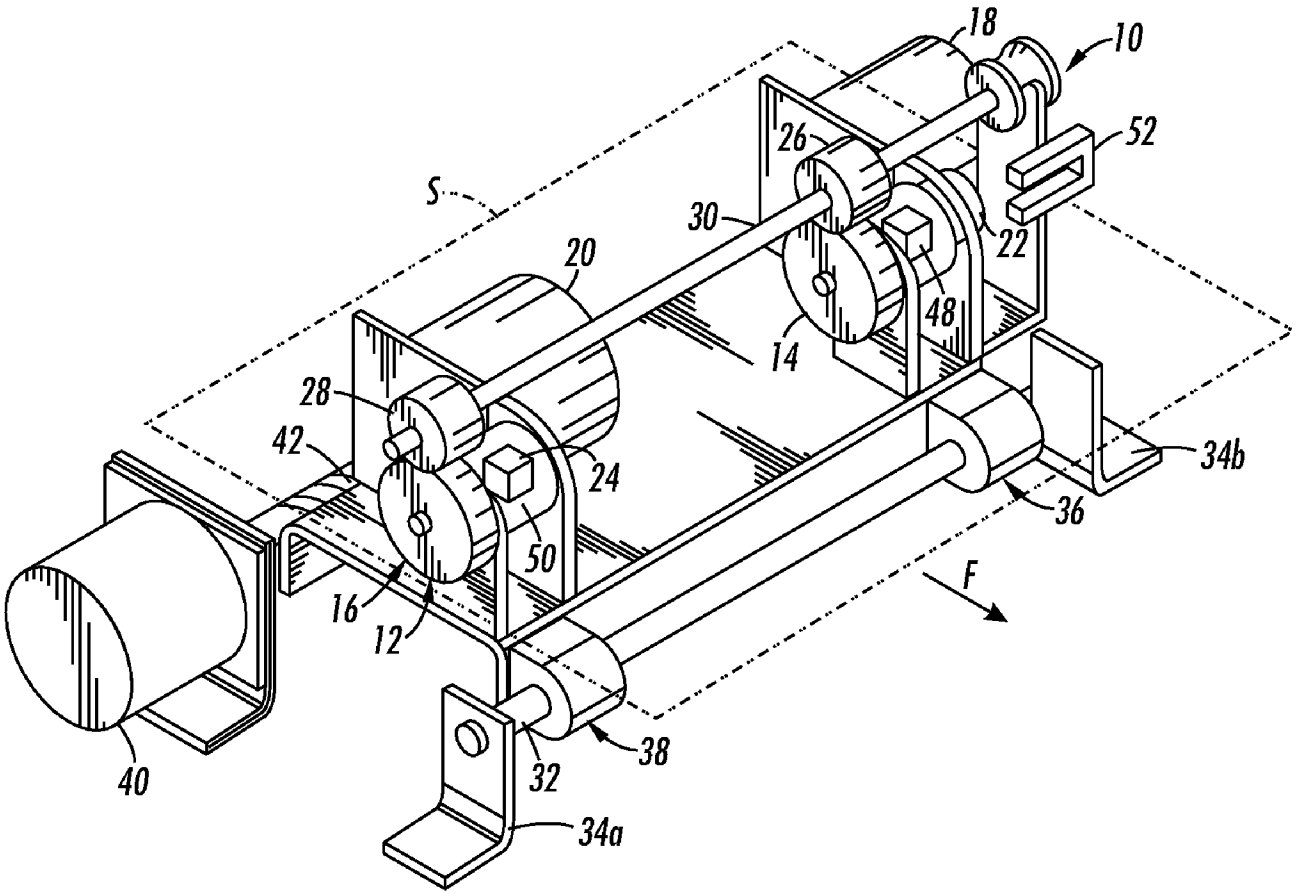
FIG. 1 (PRIOR ART)
FIG. 1 is an isometric view of a prior art sheet registration system.

Turning now to FIG. 1, a prior art embodiment of a sheet registration system is shown. The system places a sheet S into proper alignment or registration for downstream processing as the sheet travels in the direction of arrow F. The registration unit 10 includes a carriage 12 having two drive rolls 14 and 16 rotatable mounted thereon by suitable means. The drive rolls 14 and 16 are driven by drive motors 18 and 20, respectively. The drive motors 18 and 20 are preferably speed controllable stepper motors, although other types of speed controllable servo motors are usable. The rotary output of each motor is transmitted to the respective drive rolls 14, 16 by suitable power transmission means, such as, belts 22, 24.

Above drive roll 14 there is rotatably mounted by suitable means a nip roll 26. A similar nip roll 28 is mounted above drive roll 16. Advantageously, the nip rolls 26 and 28 are commonly coaxially mounted for rotation about the axis of a cross shaft 30, which is mounted on the carriage 12. The roll pairs 14, 26, 16, 28 engage the sheet S and drive it through the registration unit 10.

The carriage 12 is mounted for movement transversely of the direction of feed indicated by arrow F. In the arrangement of FIG. 1, this is accomplished by mounting one edge of the carriage 12 on the guide 32, which extends perpendicularly to the direction of sheet feed. The guide 32 is supported on the frame on which the registration system is mounted by a pair of opposed supports 34*a* and 34*b*. The carriage 12 is mounted on the guide 32 by a pair of bearings 36 and 38, which are slidably received on the guide 32.

Figure 2:
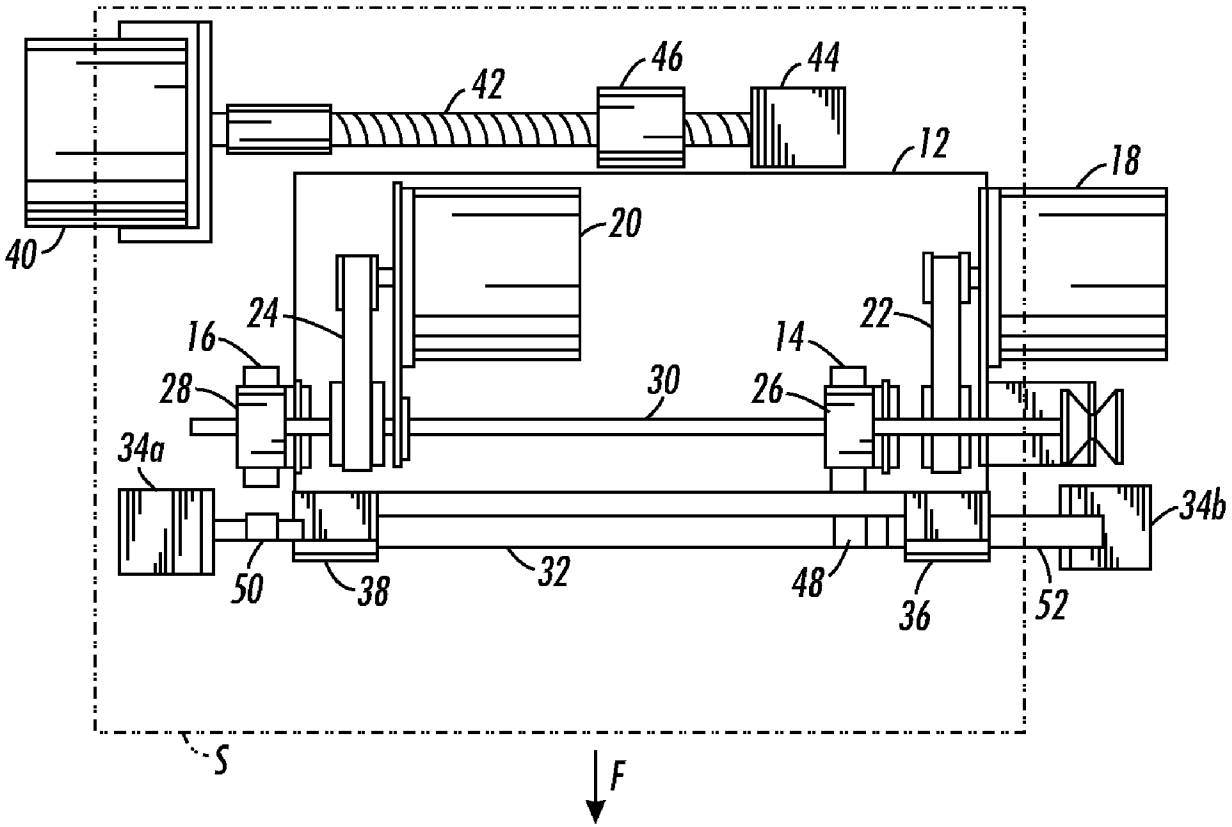
FIG. 2 (PRIOR ART)
FIG. 2 is a top view of the prior art sheet registration systems of FIG. 1.

Referring to FIG. 2, the carriage 12 is moved transversely of the feed path by a drive system including a speed controllable stepper motor 40 or other similar speed controllable servo motor. The output shaft of the motor 40 drives a lead screw 42 which is rotatably supported at the end opposite the motor by suitable bearing support 44. The motor 40 and support 44 are mounted on the frame of the equipment in which the registration system is used. A block 46 having an internally threaded bore is mounted on the carriage. The threads of the internal bore of the block 46 engage the threads of the lead screw and it will be readily appreciated that as the motor 40 rotates the lead screw 42, the carriage will be driven transversely as the block 46 travels along lead screw 42. The direction of rotation of motor 40 governs the direction of movement of the carriage 12.

Referring again to FIG. 1, the registration system includes detectors for detecting the position of the sheet with respect to the registration system. Preferably, the detectors are optical detectors which will detect the presence of edges of the sheet S. For lead edge detection of the sheet, two detectors 48 and 50 are mounted on the carriage 12 adjacent the drive rolls 14 and 16, respectively. The detectors 48 and 50 detect the leading edge of the sheet S as it is driven past the sensors. The sequence of engagement of the sensors 48 and 50 and the amount of time between each detection is utilized to generate control signals for correcting skew of the sheet by variation in the speed of drive rolls 14 and 16.

A top or lateral edge sensor 52 is suitably mounted on the frame of the equipment on which the registration system is mounted. This optical detector is arranged to detect the top edge of the sheet and the output therefrom is used to control transverse drive motor 40. The basic logic of operation provides that, if the sensor 52 is covered by the sheet, the motor 40 will be controlled to move the carriage to the left in FIG. 1. If, on the other hand, one of the sensors 48, 50 indicates the presence of the leading edge of the sheet, and if sensor 52 remains uncovered, then the motor 40 is driven to move the carriage 12 rightwardlly. Preferably, the carriage is driven past the transition point, at which the lateral edge of the sheet is detected by the change of state of the sensor 52. Then the drive is reversed to position the lateral edge at the transition point.

Figure 3:
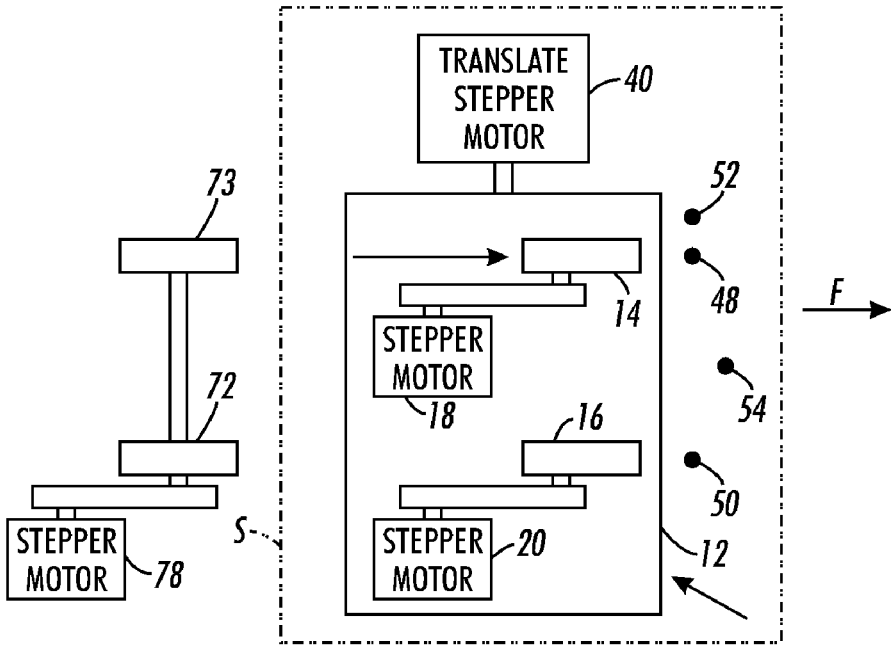
FIG. 3 is a schematic illustration of a registration system in accordance with the present disclosure showing the location of pre-registration rolls that are parts of non-releasable nips.

In FIG. 3, and in accordance with the present disclosure, an arrangement shows a fourth sensor 54, which may be an optical sensor, mounted in the feed path of sheets to detect the position of the lead edge of the sheets. The arrival time of the leading edge of sheet S at sensor 54 is compared with a reference signal, for example, one occurring after skew corrections is complete, to derive a process direction error correction value. This value is compared with a desired value and the velocity of the drive rolls 14 and 16 is temporarily increased or decreased so that the leading edge of the sheet reaches a desired point in the feed path in synchronization with a downstream operation. Pre-registration drive rolls 72 and 73 are desirable in higher speed systems, and particularly ones for handling large sheets of paper. Drive roll 72 forms a nip with idler roll 74 and drive roll 73 forms a nip with another idler roll (not shown). These rolls drive paper into registration rolls 14, 16 where registration system 10 begins making adjustments to the position of the sheet. A buckle is created between pre-registration drive rolls 72, 73 and registration sheet drive rolls 14, 16 and is used for relieving the stresses in the sheet due to the differential displacements of drive nips during the registration correction process. As the registration proceeds, a buckle is created between registration rolls 14, 16 and pre-registration rolls 72, 73 and the differential displacements of drive nips for correcting the registration errors are absorbed by the buckle. The velocities of the registration nips and the pre-registration nips are closely controlled through conventional drive circuits by controller 59 of FIG. 5 so that the magnitude of buckle between them is large enough to relieve the stresses in the sheet during the registration process.

Figure 4:
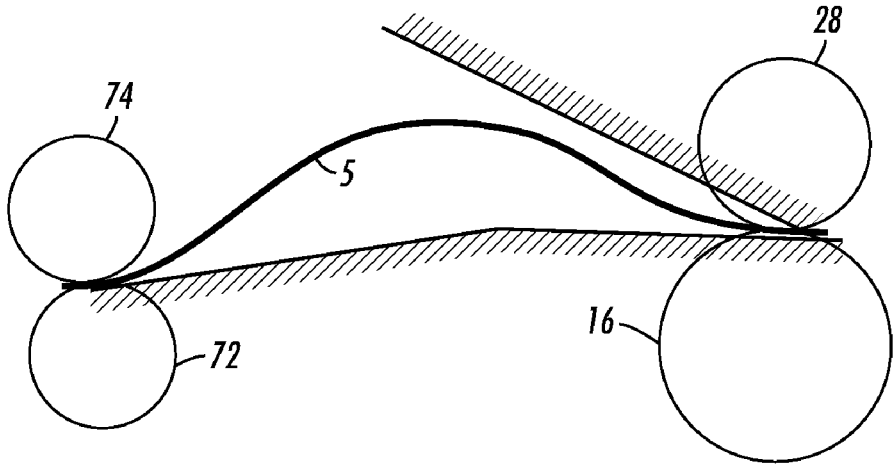
FIG. 4 is an enlarged, partial, schematic side view showing a non-releasable pre-registration nip in accordance with the present disclosure and a registration nip.

FIG. 4 shows a buckled sheet S during the registration process. The buckle may be uneven in the lateral direction. In addition, the pre-registration nip 72, 74 is tilted or slanted with respect to a horizontal plane through the registration nip 16, 28 to aid in initiating the buckle in the right direction. The tilting also helps in making the sheet flexible enough to start the registration corrections as soon as the lead edge gets into the registration nips and the registration errors are measured. The buckle between the pre-registration and registration nips is easily created by making the speed of the registration nips slower than the pre-registration nips through controller 59 of FIG. 5. During the registration process, the magnitude of buckle has to be large enough to absorb the differential displacement of the inboard and outboard registration nips for correcting skew and translating movement of the registration nips without creating excessive stresses in the sheet being registered. The magnitude of buckle is defined as the incremental sheet length between the registration nips and pre-registration nips calculated from the sheet length when the sheet lead edge gets into the registration nips. Then the buckling rate, the magnitude of buckle divided by time, is proportional to the speed difference between the registration nips and the pre-registration nips. Since the speeds of the registration nips have to also be controlled for correcting any timing error in the process direction, it is preferable and easier to control the speed of the pre-registration nips relative to the speed of the registration nips for controlling the buckling rate. Once the target value for buckle is achieved, the target value is maintained by synchronizing the speed of the pre-registration nips to that of the registration nips. The target value for buckle may be determined from the worst case of the registration errors provided as a specification. It is desirable that the distance between the registration nips and the pre-registration nips is as long as possible to reduce the buckle force and to increase the sheet flexibility. The upstream nips have to be controlled closely with the downstream nips since registration in the process direction is achieved in addition to the buckle creation. That is, the upstream nips are controlled relative to the downstream nips. Any conventional software, such as, RedurDyn or ABAQUS can be used to determine the critical parameters for buckling, deskewing, and translating movements, etc.

Figure 5:
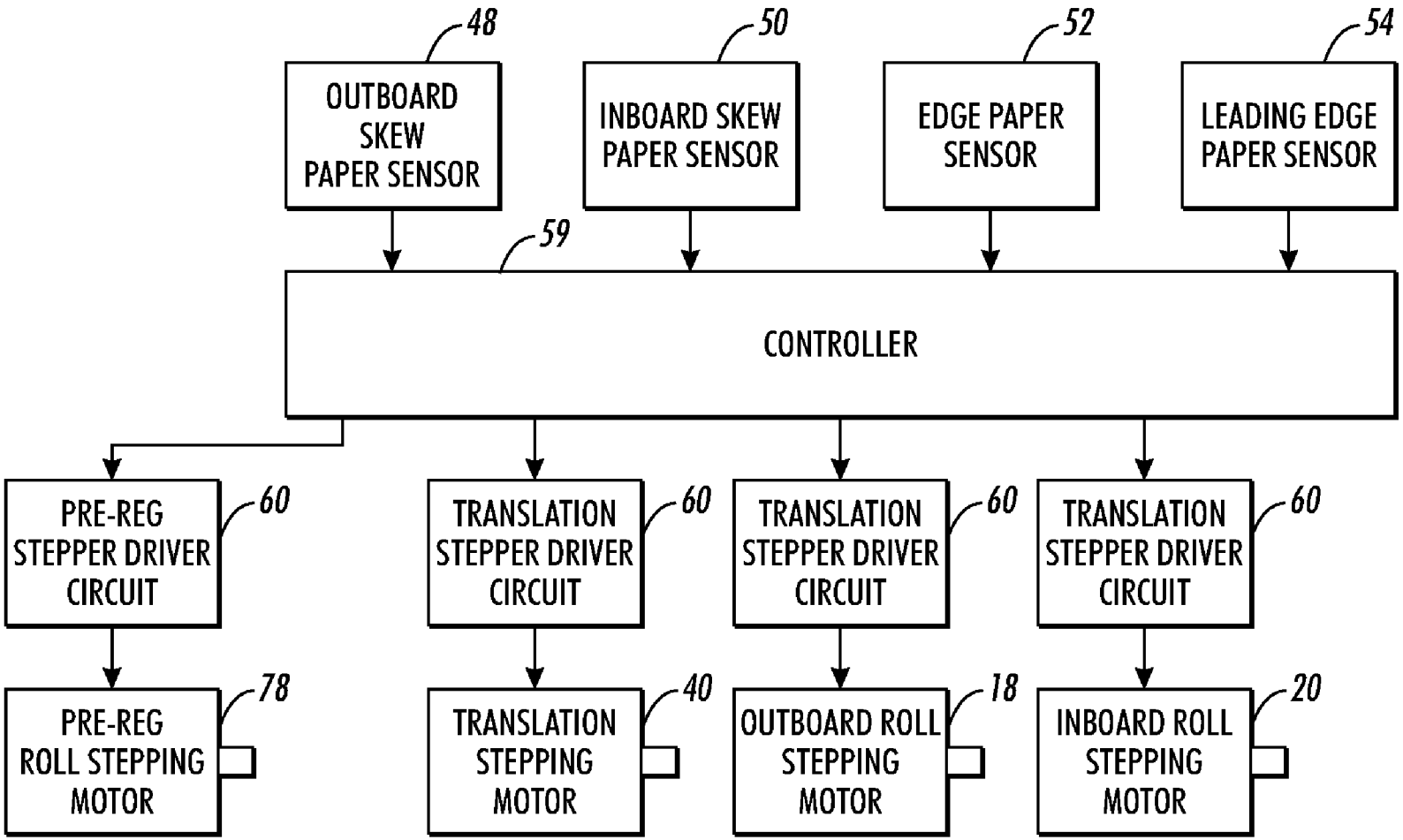
FIG. 5 is a block diagram of one form of control for the sheet registration system of the present disclosure.

As shown in FIG. 5, signals for the edge sensors 48, 50, 52 and alternatively sensor 54, are provided to a controller 59. In a preferred arrangement, sensors 48 and 50 are utilized for both skew corrections and longitudinal gating. In an alternative arrangement, if higher speed or accuracy is necessary, it may be desirable to employ a forth sensor 54, for deriving signals necessary for longitudinal gating.

The controller 59 can be a typical microprocessor which is programmed to calculate correction values required and provide control outputs for effecting appropriate action of the pre-registration stepper motor 78 along with the stepper motors 18, 20 and 40. Such microprocessor control systems are well known to those of skill in the art and no detailed description thereof is necessary. Outputs of the microprocessor are provided to driver control circuits 60, for controlling speeds and duration of drive of stepper motors 18, 20, 40 and 78. Suitable drive circuits are known in the art and further detailed explanation is unnecessary.

The foregoing registration system has a major advantage over registration systems using stalled roll registration with buckle creating mechanisms, and translating electronic registration systems with pre-registration nip release mechanisms because there is no need to stall the registration roll or for a pre-registration nip release mechanism and its attendant parts because the buckle that is created is tightly controlled in order to ensure that the buckle does not increase indefinitely and destroy timing with the image processor for image transfer or cause a jam in the paper path. By tightly controlling the magnitude of each buckle a wide variety of sheet lengths can be accommodated while simultaneously achieving registration in the process direction and allowing increased speed in sheet flow.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. In a high speed apparatus for registering a sheet in a feed path, including first and second sheet drive rolls rotatably mounted in the feed path for rotation about respective first and second coaxial axes transverse to the feed path, a first motor for moving the first and second sheet drive rolls transversely with respect to the feed path, second and third motors for independently rotatably driving the first and second sheet drive rolls, sensors for detecting the transverse, longitudinal and skew positioning of a sheet in the feed path, a controller responsive to detection of longitudinal mispositioning of a sheet in the feed path by said sensors to change the drive speed of the first and second sheet drive rolls, responsive to the detection of skew mispositioning of a sheet in the feed path by the sensors to change the speed of one sheet drive roll with respect to the other and responsive to the detection of transverse mispositioning to initiate movement of the first and second sheet drive rolls transversely, the improvement comprising;

pre-registration sheet drive rolls positioned upstream of said first and second sheet drive rolls and adapted to cooperate with said first and second sheet drive rolls to create a buckle in a sheet captured therebetween, and wherein the velocities of each of said pre-registration sheet drive rolls and said first and second sheet drive rolls are adjusted by said controller in order to control the magnitude of said buckle.

2. The apparatus of claim 1, wherein said pre-registration sheet drive rolls are simultaneously controlled with said first and second sheet drive rolls in order to achieve both process direction registration and buckle creation.

3. The apparatus of claim 2, wherein a signal from said sensors is used to detect the arrival time of a leading edge of the sheet, and wherein said arrival time of the lead edge of the sheet is compared with a reference signal to derive a process direction error correction value.

4. The apparatus of claim 3, wherein said process direction error correction value is compared with a desired value and the velocity of said first and second sheet drive rolls is temporarily increased or decreased so that the leading edge of the sheet reaches a desired point in the feed path in synchronization with a downstream operation.

5. The apparatus of claim 4, wherein the speed of said first and second sheet drive rolls is slower than that of said pre-registration sheet drive rolls when the sheet lead edge initially contacts said first and second sheet drive rolls.

6. The apparatus of claim 5, wherein the magnitude of the buckle is large enough to absorb the differential displacement of said first and second sheet drive rolls for correcting skew and translating movement without placing excessive stresses on the sheet.

7. The apparatus of claim 6, wherein control of the speed of said pre-registration sheet drive rolls relative to said first and second sheet drive rolls by said controller achieves a target value for buckle magnitude.

8. The apparatus of claim 7, wherein said target value is maintained by synchronizing the speed of said pre-registration sheet drive rolls with that of said first and second sheet drive rolls.

9. The apparatus of claim 8, wherein said pre-registration drive rolls and said first and second sheet drive rolls form sheet driving nips with mating idler rolls.

10. A method for registering a sheet in a feed path, including:

providing first and second sheet drive rolls rotatably mounted in the feed path for rotation about respective first and second coaxial axes transverse to the feed path;

providing a first motor for moving said first and second sheet drive rolls transversely with respect to the feed path;

providing second and third motors for independently rotatably driving said first and second sheet drive rolls;

providing sensors for detecting the transverse, longitudinal and skew positioning of a sheet in the feed path;

using a signal from said sensors for detecting the arrival time of a leading edge of the sheet;

comparing said arrival time of the lead edge of the sheet with a reference signal to derive a process direction error correction value;

providing a controller that is responsive to detection of longitudinal mispositioning of a sheet in the feed path by said sensors to change the drive speed of said first and second sheet drive rolls, responsive to the detection of skew mispositioning of a sheet in the feed path by said sensors to change the speed of one sheet drive roll with respect to the other and responsive to the detection of transverse mispositioning to initiate movement of said first and second sheet drive rolls transversely; and providing pre-registration sheet drive rolls positioned upstream of said first and second sheet drive rolls and adapted to cooperate with said first and second sheet drive rolls to create a buckle in a sheet captured therebetween, and wherein the velocities of said pre-registration sheet drive rolls and said first and second sheet drive rolls are adjusted by said controller in order to control the magnitude of said buckle.

11. The method of claim 10, including simultaneously adjusting said velocities of said pre-registration sheet drive rolls and said first and second sheet drive rolls in order to achieve both process direction registration and buckle creation.

12. The method of claim 11, including using a signal from said sensors to detect the arrival time of a leading edge of the sheet, and wherein said arrival time of the lead edge of the sheet is compared with a reference signal to derive a process direction error correction value.

13. The method of claim 12, wherein said process direction error correction value is compared with a desired value and the velocity of said first and second sheet drive rolls is temporarily increased or decreased so that the leading edge of the sheet reaches a desired point in the feed path in synchronization with a downstream operation.

14. The method of claim 13, including enhancing registration in the process direction by said controlling the velocities of said pre-registration sheet drive rolls relative to said first and second sheet drive rolls.

15. The method of claim 14, including making the speed of first and second sheet drive rolls slower than that of said pre-registration sheet drive rolls when the sheet lead edge initially contacts said first and second sheet drive rolls.

16. The method of claim 15, including providing the magnitude of the buckle large enough to absorb the differential displacement of said first and second sheet drive rolls for correcting skew and translating movement without placing excessive stresses on the sheet.

17. The method of claim 16, including achieving a target value for the buckle by controlling the speed of said pre-registration sheet drive rolls relative to said first and second sheet drive rolls.

18. The method of claim 17, including maintaining said target value by synchronizing the speed of said pre-registration sheet drive rolls with that of said first and second sheet drive rolls.

19. The method of claim 18, wherein said pre-registration drive rolls and said first and second sheet drive rolls form sheet driving nips with mating idler rolls.

* * * * *